US006301456B1

(12) United States Patent
Horrall et al.

(10) Patent No.: US 6,301,456 B1
(45) Date of Patent: Oct. 9, 2001

(54) METHOD AND APPARATUS FOR INSERTING A CARTRIDGE INTO AN IMAGE FORMING APPARATUS

(75) Inventors: Paul Douglas Horrall, Lexington; Franklin Joseph Palumbo, Nicholasville; Gregory Lawrence Ream, Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/668,264

(22) Filed: Sep. 22, 2000

(51) Int. Cl.[7] ..... G03G 15/00
(52) U.S. Cl. ..... 399/111; 399/113
(58) Field of Search ..... 101/116, 128; 399/110, 111, 112, 113, 119, 299

(56) References Cited

U.S. PATENT DOCUMENTS 3,740,132 * 6/1973 Komuri et al. ..... 399/111
4,444,494 * 4/1984 Koyama et al. ..... 399/111
4,699,494 10/1987 Honda .
5,014,094 * 5/1991 Amitani et al. ..... 399/111
5,095,335 3/1992 Watanabe et al. .
5,138,374 8/1992 Bellis .
5,585,902 12/1996 Nishiuwatoko et al. .
5,768,661 6/1998 Coffey et al. .
5,848,329 * 12/1998 Aoyama et al. ..... 399/113
5,890,034 3/1999 Nakano et al. .

* cited by examiner

*Primary Examiner*—Arthur T. Grimley
*Assistant Examiner*—Hoang Ngo
(74) *Attorney, Agent, or Firm*—David D. Kalish

(57) ABSTRACT

An image forming apparatus having an image forming body with an opening along at least one side. Guide rails are mounted to the image forming body above the opening, and a pair of support members are positioned within the image forming body below the guide rails. The apparatus further includes a cartridge having support arms extending outward for contacting the guide rails during insertion and removal from the image forming body. The cartridge also includes a photoconductive drum positioned on a lower portion of the cartridge, and when inserted into the image forming body, the cartridge is supported by resting the photoconductive drum on the support members.

38 Claims, 12 Drawing Sheets

METHOD AND APPARATUS FOR INSERTING A CARTRIDGE INTO AN IMAGE FORMING APPARATUS

FIELD OF THE INVENTION

The present invention relates in general to an electrophotographic image forming apparatus and, more particularly, to a side loading cartridge that is removably mounted within the image forming apparatus and includes support arms mounted on an upper end of the cartridge for support while loading.

DESCRIPTION OF THE PRIOR ART

Image forming devices including copiers, laser printers, facsimile machines, and the like, often include removable cartridges that can be easily removed and replaced. Each cartridge usually includes a photoconductive drum, a developer housing, and a cleaner housing. The photoconductive drum has a rigid cylindrical surface that is charged to a uniform electrical potential and then selectively exposed to light from a laser imaging device in a pattern corresponding to an original image. Those areas on the photoconductive surface exposed to light are discharged thus forming a latent electrostatic image on the photoconductive surface. The developer housing contains toner that is brought in to contact with the photoconductive drum. The toner is selectively attracted to the latent electrostatic image on the photoconductive surface and transferred to an intermediate transfer medium or a final output sheet. The residual toner not transferred to the output sheet is removed from the photoconductive drum into the cleaner housing.

The life of a cartridge is often dictated by the amount of toner stored within the developer housing. Once all the toner has been distributed to the photoconductive drum, the user simply removes the cartridge from the body of the image forming apparatus and inserts a new replacement cartridge. Removal should enable a user to simply grab an exposed edge and pull the cartridge from the image-forming apparatus. Likewise, replacement should be straightforward and preferably provide for an indication that the cartridge is properly seated within the body of the image forming apparatus. Additionally, for color devices having multiple cartridges, each cartridge should be able to be removed and replaced without affecting the remaining cartridges.

A drawback of previous image-forming apparatus designs is that the laser-imaging device often must be moved during the installation and removal of a cartridge. Movement and repositioning of the laser may affect the reference positions of the laser resulting in printing errors when the laser is not properly reoriented. It is preferable that the laser-imaging device remain stationary and that the cartridges be installed and removed without affecting their positioning.

Another disadvantage of previous image-forming apparatus is their large overall size. Many users desire a device having the smallest possible dimensions because they are easier to manipulate and move, and occupy a minimal amount of desk space in a workstation where available space is often at a premium. Several previous designs have provided support means for the cartridge on areas that result in a larger cartridge size. This in turn results in a larger overall printer size. This problem is multiplied in device designs that have more than one cartridge.

Thus, there remains a need for accurately positioning a cartridge within an image-forming apparatus without requiring a large amount of space.

SUMMARY OF THE INVENTION

The present invention provides for an image forming apparatus with removable cartridge. The cartridge is installed and removed from the body of the apparatus by support arms positioned along an upper section of the cartridge that slide along guide rails positioned within the apparatus. Once the cartridge is completely installed within the apparatus, the guide rails and support arms decouple, and the cartridge is supported by placing a photoconductive drum positioned along a lower section of the cartridge on support arms mounted within the apparatus.

The cartridge includes a photoconductive drum, and a developer housing positioned adjacent to the photoconductive drum for supplying toner. Support arms extend from the developer housing for supporting the cartridge during installation and removal from the image forming apparatus. The support arms are positioned on the cartridge vertically above the photoconductive drum when mounted in the image forming apparatus.

Another embodiment includes an image forming apparatus having an image forming body with at least one laser imaging device positioned at an upper section. An opening extends along at least one side of the body below the laser imaging device. The body also includes guide rails mounted adjacent to the opening and support members positioned adjacent to the opening opposite the guide rails. At least one cartridge is removably mounted within the body. The cartridge includes a developer housing with support arms for removably mounting on the guide rails, and a photoconductive drum adjacent to the developer housing for receiving toner. When completely inserted, the cartridge is supported within the image forming body by the photoconductive drum positioned against the support members.

Another embodiment includes a body having support members positioned along a lower section of the body and guide rails positioned along an upper section. A cartridge includes a support arm configured to slide along the guide rails during insertion of the cartridge into the body to elevate the cartridge above the support members and lower the cartridge onto the support members when the cartridge is completely inserted into the body. When the cartridge is completely inserted, the support arms decouple from said guide rails.

Preferably, the support arm is angled downward on a leading edge and the guide rails are raised at a back edge. During insertion of the cartridge into the body, the support arm leading edge slides along a front end of the guide rail to lower cartridge front end and cartridge trailing edge travels over the raised back edge to lower cartridge back end.

The invention also provides for a method of removably mounting a cartridge within an image forming apparatus. The first step is aligning the cartridge support arms within guide rails mounted to the image forming apparatus. The next step is pushing the cartridge into the image forming apparatus by sliding the support arms along the guide rails and decoupling the support arms from the guide rails. Finally, supporting the cartridge within the image forming apparatus by positioning the cartridge on a support member within the image forming apparatus.

Another method includes sliding the cartridge into the image forming apparatus by pushing the support arms along the guide rails. The next step is lowering a first cartridge end into the image forming apparatus by sliding a ramping surface on the support arms over an inner end of the guide rails. The final step is lowering a second cartridge end into the image forming apparatus by sliding the support arms over an upper edge of the guide rails.

DETAILED DESCRIPTION OF THE PREFERRED EMBODIMENTS

Figure 1:
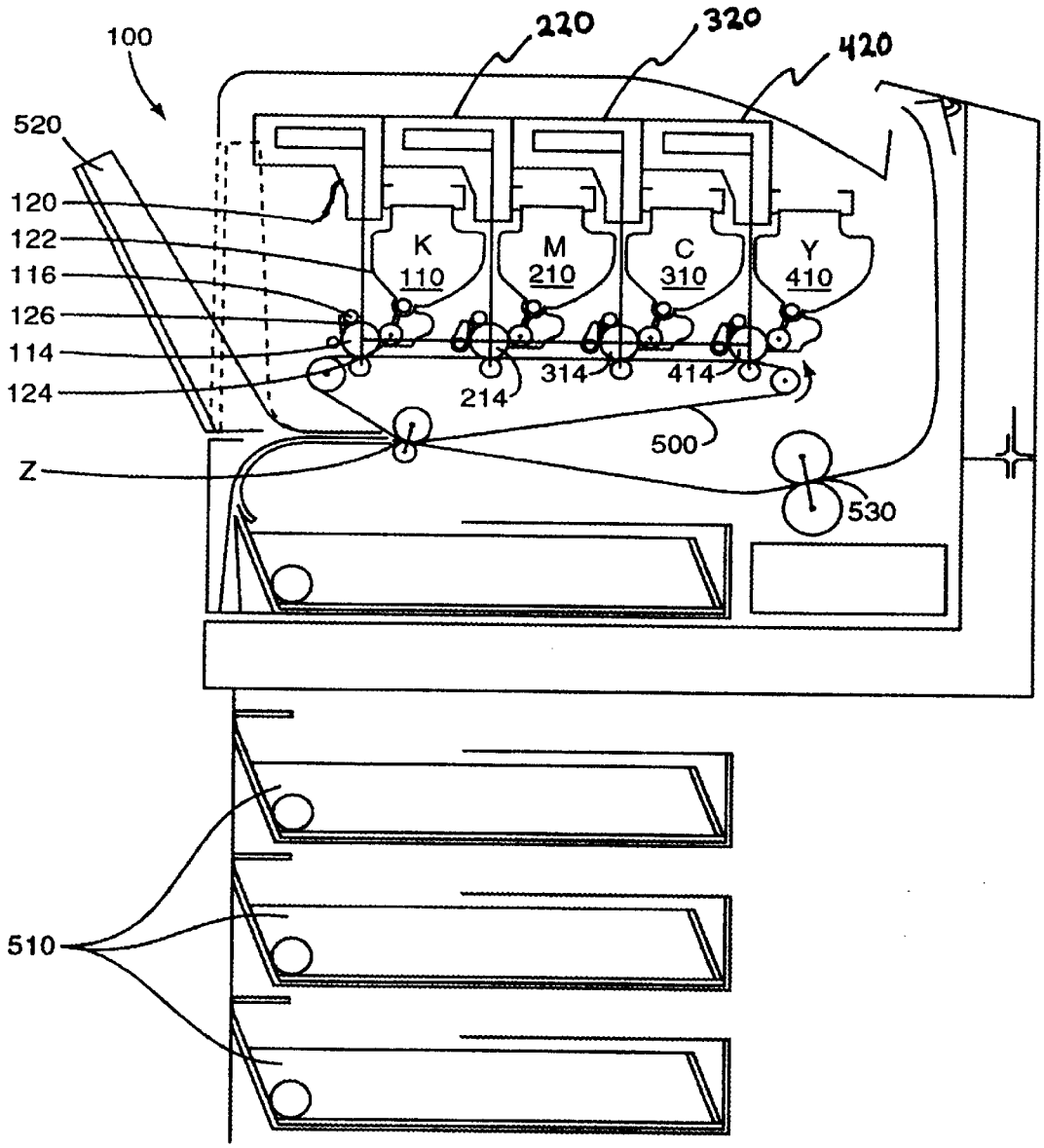
FIG. 1 is a side view illustrating the elements of an image forming apparatus constructing in accordance with the present invention.

FIG. 1 illustrates the basic elements of an image forming device and is incorporated for an understanding of the overall electrophotographic image forming process. A color laser printer is illustrated as 100, however, one skilled in the art will understand that the present invention is applicable to other types of image forming devices using toner for printing through a photoconductive drum. The image forming apparatus, generally designated 100, includes a plurality of similar toner cartridges 110, 210, 310, and 410. Each toner cartridge has similar construction but is distinguished by the toner color contained therein. In the preferred embodiment, the device includes a black cartridge 110, a magenta cartridge 210, a cyan cartridge 310, and a yellow cartridge 410. The different color toners form individual images of a single color that are combined in layered fashion to create the final multi-colored image.

Each of the toner cartridges is substantially identical and includes a developer housing, a drum, and a cleaner housing. As the cartridges are respectively identical except for the toner color, the cartridge and elements for forming black images will be described, with the other cartridges being omitted for simplification.

The drum 114 is generally cylindrically-shaped with at least one end having a gear or spokes 80 for coupling with the image forming device cartridge drive module to provide for a rotational force. A coupler or other connection means extends outward from the image forming device and couples with the cartridge upon insertion for transferring rotary motion to the drum 114. The drum 114 has a smooth surface for receiving an electrostatic charge over the surface as the drum rotates past charging roller 116. The drum continuously and uniformly rotates through a laser imaging device 120 that directs a laser onto a selected portion of the drum surface forming an electrostatically latent image across the width of the drum representative of the outputted image. This process continues as the entire image pattern is formed on the drum surface. Preferably, the laser imaging device 120 is positioned above the removable cartridges and is not disturbed during cartridge removal and insertion.

After receiving the latent image, the drum rotates through a developer housing 122 having a toner bin for housing the toner and a developer roller 124 for uniformly transferring toner to the drum. The toner is a fine powder usually constructed of plastic granules that are electrostatically driven to the areas of the drum that have been discharged by the laser imaging device 120 in a discharged area development (DAD) process. The toner particles cling to the latent electrostatic image in these areas. A charged area development (CAD) process may also be used.

The drum next rotates past an adjacently positioned intermediate transfer medium belt 500 (hereinafter, ITM belt) where the toner is transferred from the drum 114. As illustrated in FIG. 1, the ITM belt 500 is endless and extends around a series of rollers adjacent to the drums. The ITM belt 500 the image on each drum 114, 214, 314, 414, and each laser scanning unit 120, 220, 320, 420 are synchronized providing for the toner from each drum to precisely align on the ITM belt during a single pass. By way of example as viewed in FIG. 1, the yellow (Y) toner will be placed on the ITM belt, followed by cyan (C), magenta (M), and black (K). After depositing the toner on the ITM belt, the drum rotates through a cleaning housing where residual toner is removed from the surface via a brush or scraper 126 and transferred to a waste toner reservoir 125.

As the drums are being charged and gathering toner, a recording sheet, such as blank sheet of paper, is being routed to intercept the ITM belt 500. The paper may be placed in one of the lower trays 510, or introduced into the image forming device through a side track tray 520. A series of rollers and belts transports the paper to point Z where the sheet contacts the ITM belt and receives the toner. Preferably, voltage is applied to one of the rollers that pushes the sheet of paper against the ITM belt at point Z to pull the charged toner away from the belt and onto the paper. The sheet and attached toner next travel through a fuser 530 having a pair of rollers and one or more heating elements that heat and fuse the toner to the sheet. The paper with fused image is then transported out of the image forming apparatus.

Each of the toner cartridges may be removed and replaced within the image forming apparatus. Replacement is usually necessary when there is no toner remaining within the developer housing 150. In a preferred embodiment illustrated in FIG. 1, the cartridges are loaded into the image forming device from a side. This provides for the laser to remain undisturbed resulting in fewer printing errors than if the laser was moved during cartridge movement.

Figure 2:
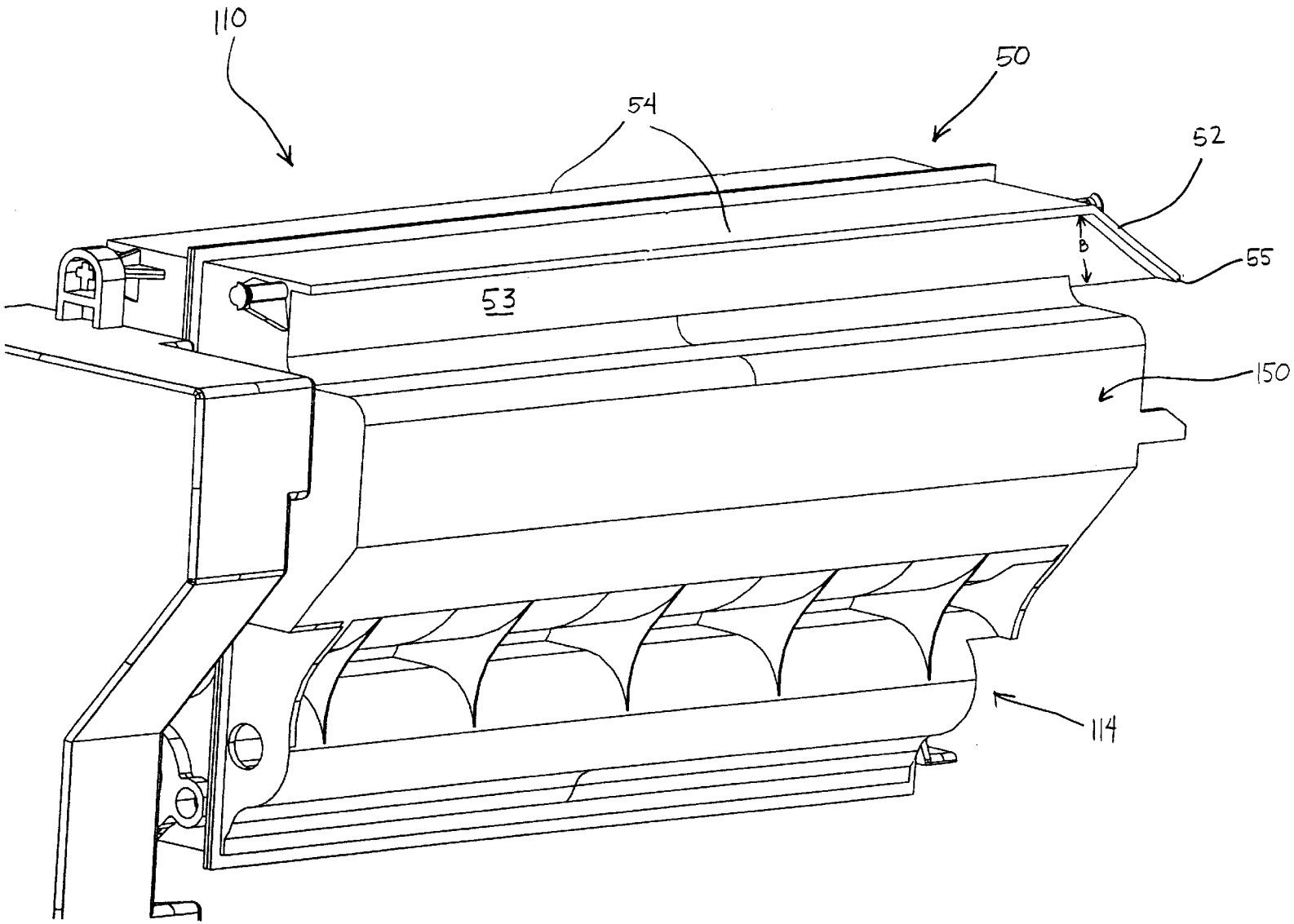
FIG. 2 is a perspective view illustrating a cartridge having support arms.

FIG. 2 illustrates the cartridge 110 having a developer housing 150 for containing a supply of toner that is to be fed to the photoconductive drum 114. Preferably, the developer housing 150 is positioned vertically above the photoconductive drum 114. Support arms 50 are positioned at an upper portion of the developer housing 150 for supporting the cartridge during insertion and removal from the image-forming apparatus 100. The support arms 50 are substantially "T"-shaped and include a linear top support 54 and a ramped support 52 at a front end of the cartridge. A base 53 extends upward from the developer housing 150. Preferably, the support arms 50 include a pair of top supports 54 for supporting the cartridge 110, although other embodiments of singular or plural supports may also be feasible. This placement of the support arms 50 utilizes space created by the focal distance required between the laser imaging device 120 and photoconductive drum 114. By utilizing this already required space for the support arms 50, the overall size of the cartridge 110 can be maintained as small as possible.

Figure 3:
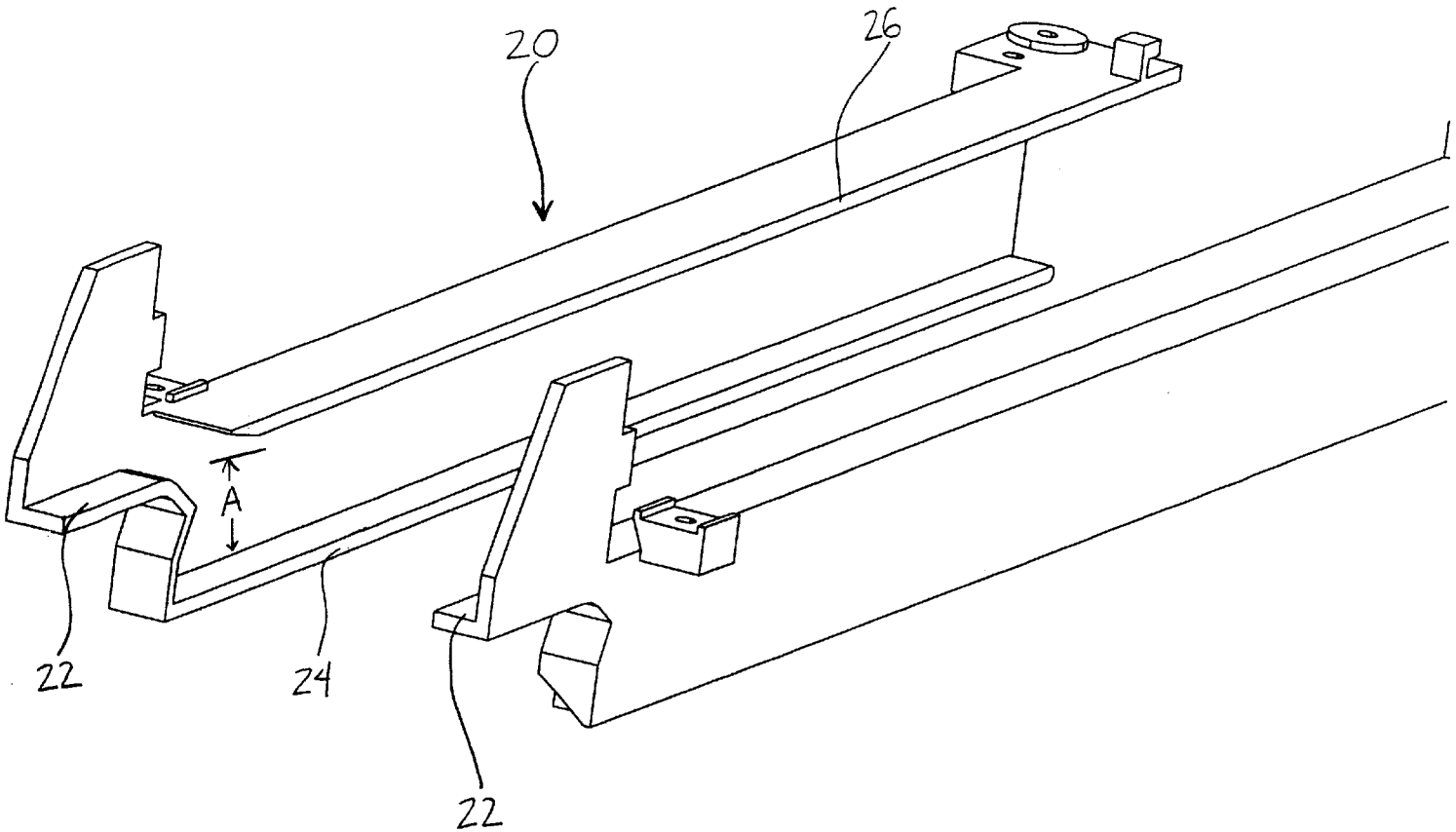
FIG. 3 is a perspective view of guide rails removed from the image forming apparatus.
Figure 4:
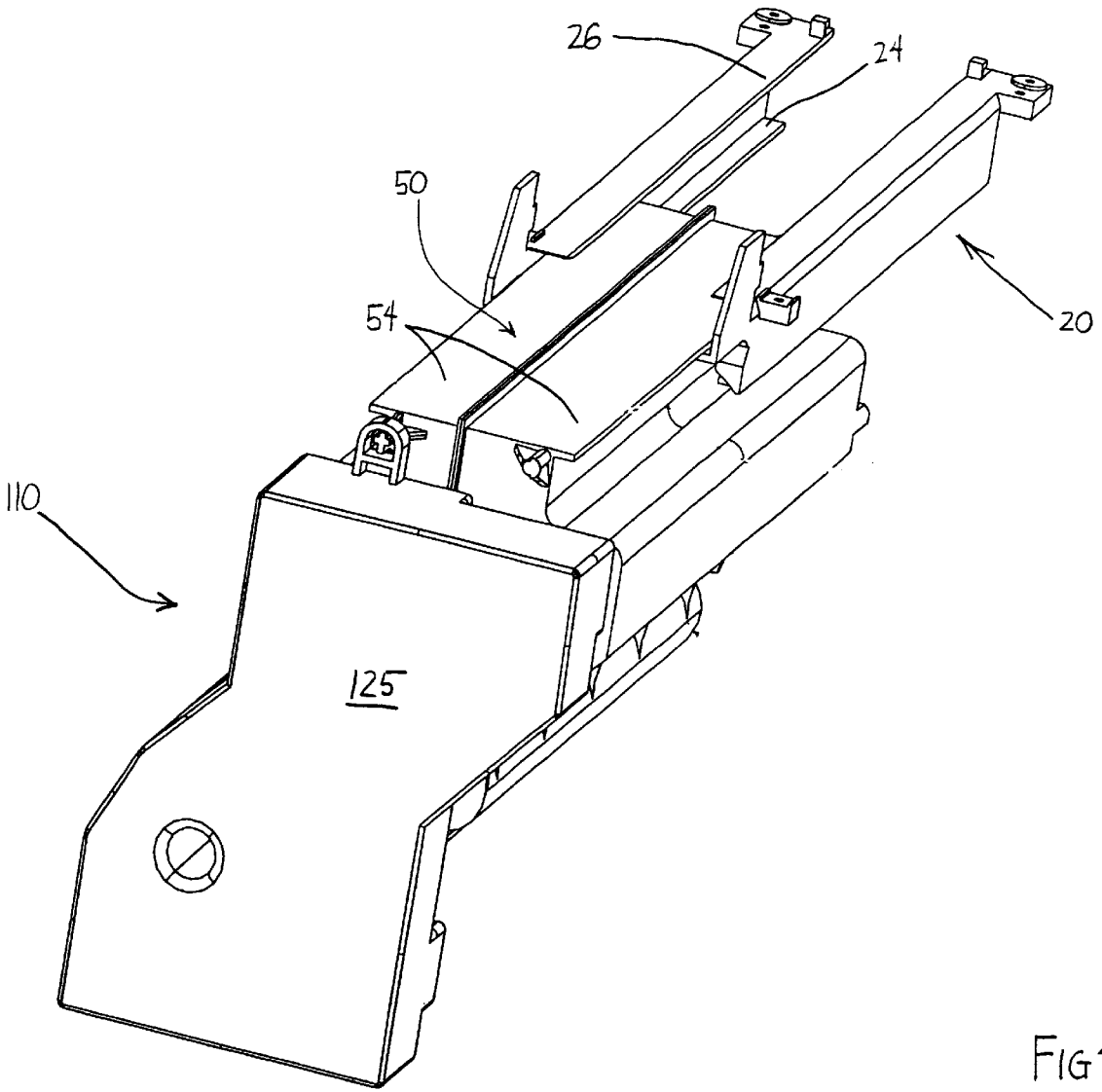
FIG. 4 is a partial perspective view of a cartridge partially inserted within the guide rails.

Guide rails 20 are mounted to the image forming apparatus for mating with the support arms 50. FIG. 3 illustrates a pair of guide rails 20 removed from the image-forming apparatus for clarity. Each guide rail 20 includes a front guide section 22 that extends inward a limited distance for supporting the cartridge during insertion and removal. When referring to the components of the cartridge 110, guide rails 20, and support arms 50, the term "front" is used to define the area nearest to the user when the cartridge is inserted into the image forming apparatus 110, and the term "back" for the opposite end. An upper guide section 26 and lower guide section 24 extends substantially parallel along the guide rail 20. Preferably, the upper guide section 26 is positioned vertically above the front guide section 22. This provides that the cartridge top supports 54 do not contact the upper guide section 26 during insertion and removal of the cartridge. However, if the cartridge 110 is only partly inserted with the center of gravity of the cartridge away from the image-forming apparatus as illustrated in FIG. 4, the top support 54 will contact the front guide section 22 and the upper guide section 26.

Preferably, the distance "A" illustrated in FIG. 3 between the front guide section 22 and the lower guide section 24 is approximately equal to the distance "B" illustrated in FIG. 2 between the top support 54 and the ramped surface bottom 55. These distances provide for the cartridge 110 to remain substantially level during insertion and removal because the ramped surface bottom 55 rides against the lower guide section 24 as the top support 54 rides against the back guide section 22.

Figure 5:
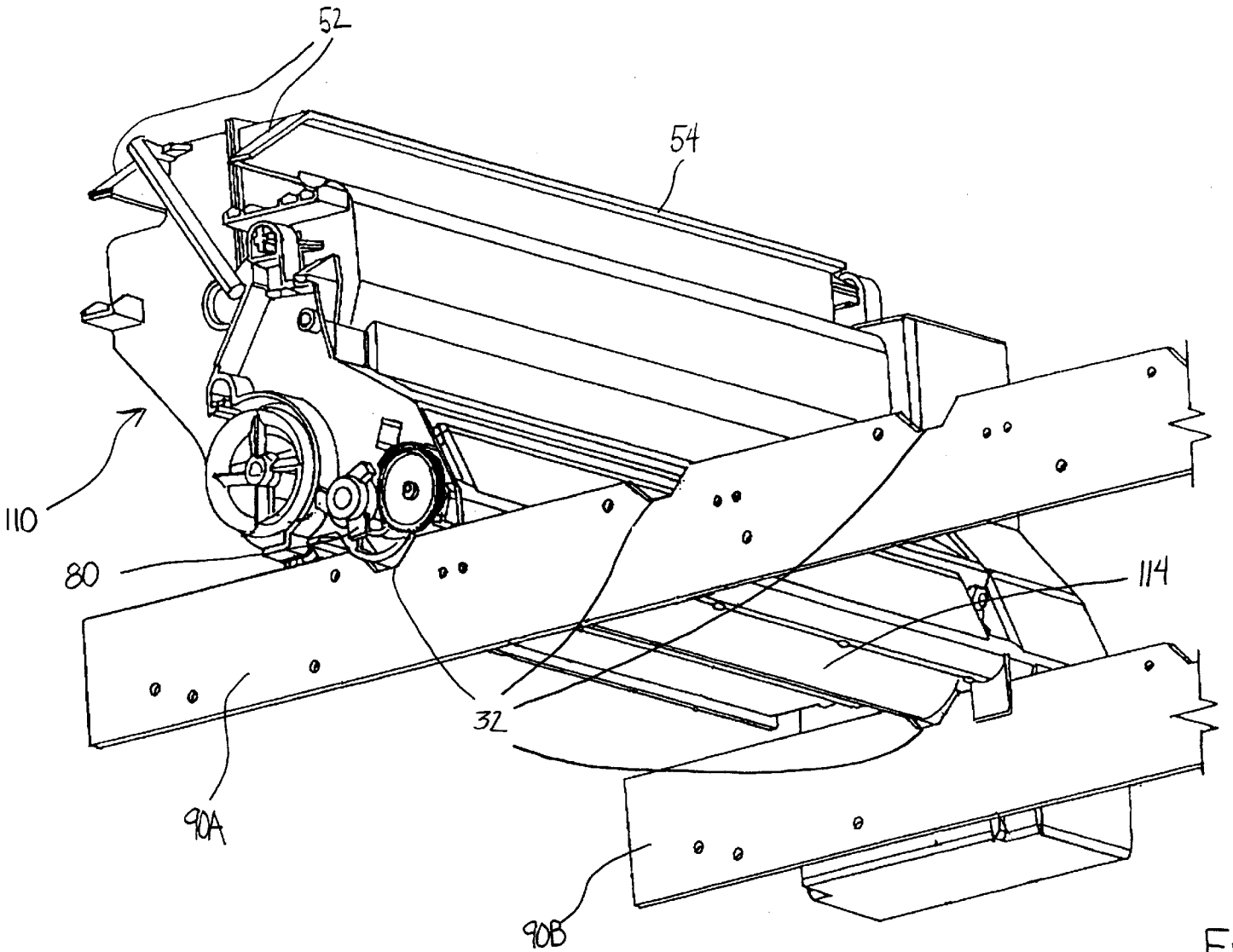
FIG. 5 is a rear perspective view of the cartridge mounted within the image forming device and seated on support members.

When the cartridge 110 is completely inserted within the image forming device, the support arms 50 decouple from the guide rails 20. Preferably, the cartridge 110 is support by the photoconductive drum 114 resting on support members 90A, 90B that extend through the image forming apparatus as illustrated in FIG. 5. However, once decoupled, the cartridge 110 may also be supported by other components within the cartridge and the image forming apparatus 100. Positioning the photoconductive drum 114 on the support arms 90A, 90B provides for accurate and precise placement of the cartridge 110. Preferably, the photoconductive drum 114 is positioned within V notches 32 within the support members 90A, 90B.

Decoupling the cartridge 110 from the guide rails provides accurate positioning within the image forming apparatus 100 and easier customer usage. The user can easily load the cartridge 110 into the guide rails 20 which are readily visible from the exterior of the image forming apparatus. Additionally, decoupling the support arms 50 once the cartridge 110 is completely installed locates the cartridge based on the more functionally important elements of the drum 114 and support members 90A, 90B.

While the cartridge 110 is being inserted into or removed from the image-forming apparatus 100, the guide rails 20 and support arms 50 maintain the photoconductive drum 114 above the support members 90A, 90B to prevent scratching or damage of the photoconductive surface. The cartridge 110 is also supported above the ITM belt 500, which is positioned between support arms 50 as illustrated in FIGS. 6A–6D. The ITM belt 500 has been removed from FIG. 5 for clarity. Once the cartridge 110 is installed within the image forming apparatus, the downward movement positions the photoconductive drum 114 on the support members 90A, 90B adjacent to the ITM belt 500.

Figure 6A:
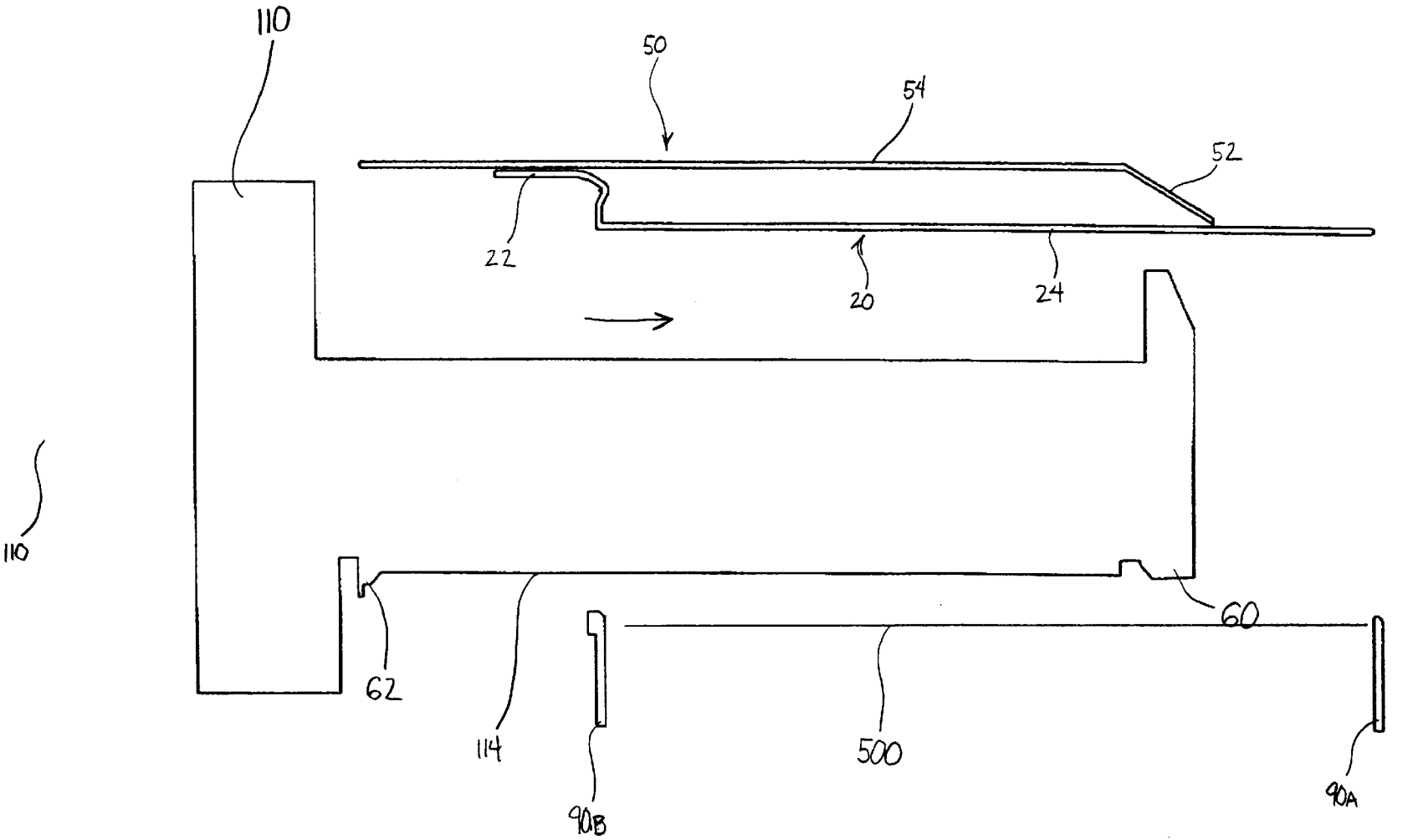
FIG. 6A is a schematic side view illustrating the cartridge being inserted into the image forming apparatus.

FIGS. 6A, 6B, 6C, and 6D illustrate the insertion of a cartridge 110 into the image-forming apparatus 100. FIG. 6A demonstrates the cartridge 110 partially inserted into the image forming apparatus 10 as the supports arms 50 slide against the guide rail 20. The cartridge 110 is maintained substantially level as the ramped Support 52 slides across the lower guide section 24 and the top support 54 slides across the front guide section 22. The bottom edge of the cartridge is maintained above the support members 90A, 90B and ITM belt 500 to prevent any possible damage.

Figure 6B:
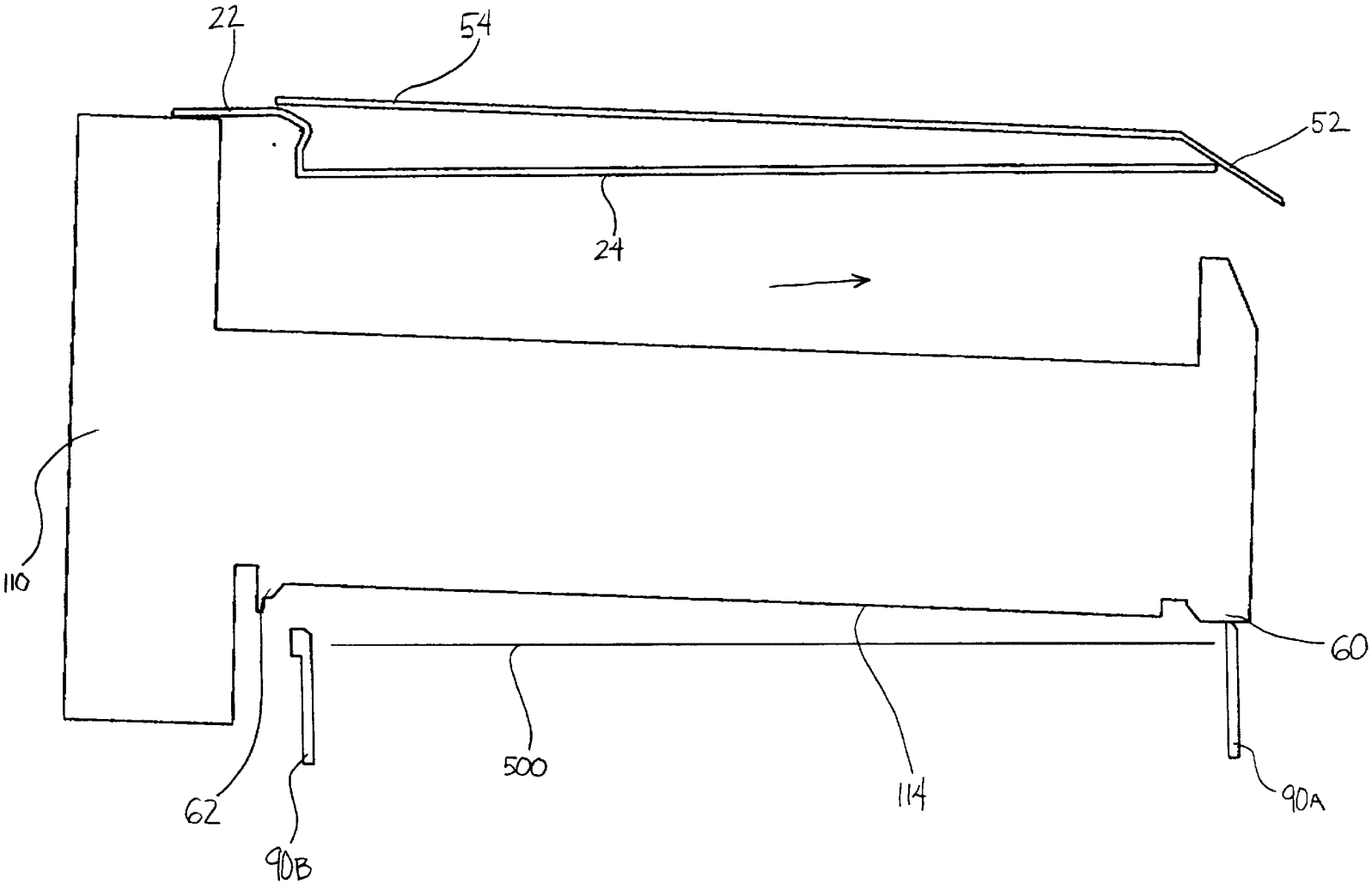
FIG. 6B is a schematic side view illustrating the cartridge being inserted into the image forming apparatus.

FIG. 6B illustrates the cartridge 110 inserted to a position such that the ramped support 52 contacts the back edge of the lower guide surface 24 while the top support 54 maintains contact with the front guide section 22. A back locator 60 contacts the top edge of the support arm 90A. It is important that the back locator 60 does not fall in front of the support arm 90A thereby blocking the insertion of a cartridge 110. As the back edge of the cartridge is being lowered, the front edge remains raised upward as the fin 54 maintains contact with the front guide section 22. This provides for the bottom edge of the cartridge to be maintained above the ITM belt 500.

Because the ramped support 52 is angled between about 30–60 degrees, pushing the cartridge 110 into the image forming apparatus results in the inserted cartridge back end having both vertical and horizontal movement. This enables spoked coupling 80 and electrical connectors (not shown) positioned on the back edge of the cartridge to be coupled to corresponding members within the image forming apparatus. If the cartridge were inserted such that there was no diagonal movement but rather only a horizontal movement followed by a vertical drop onto the support members 50, the spoked coupling 80 and electrical connectors may not couple with the image forming apparatus.

Figure 6C:
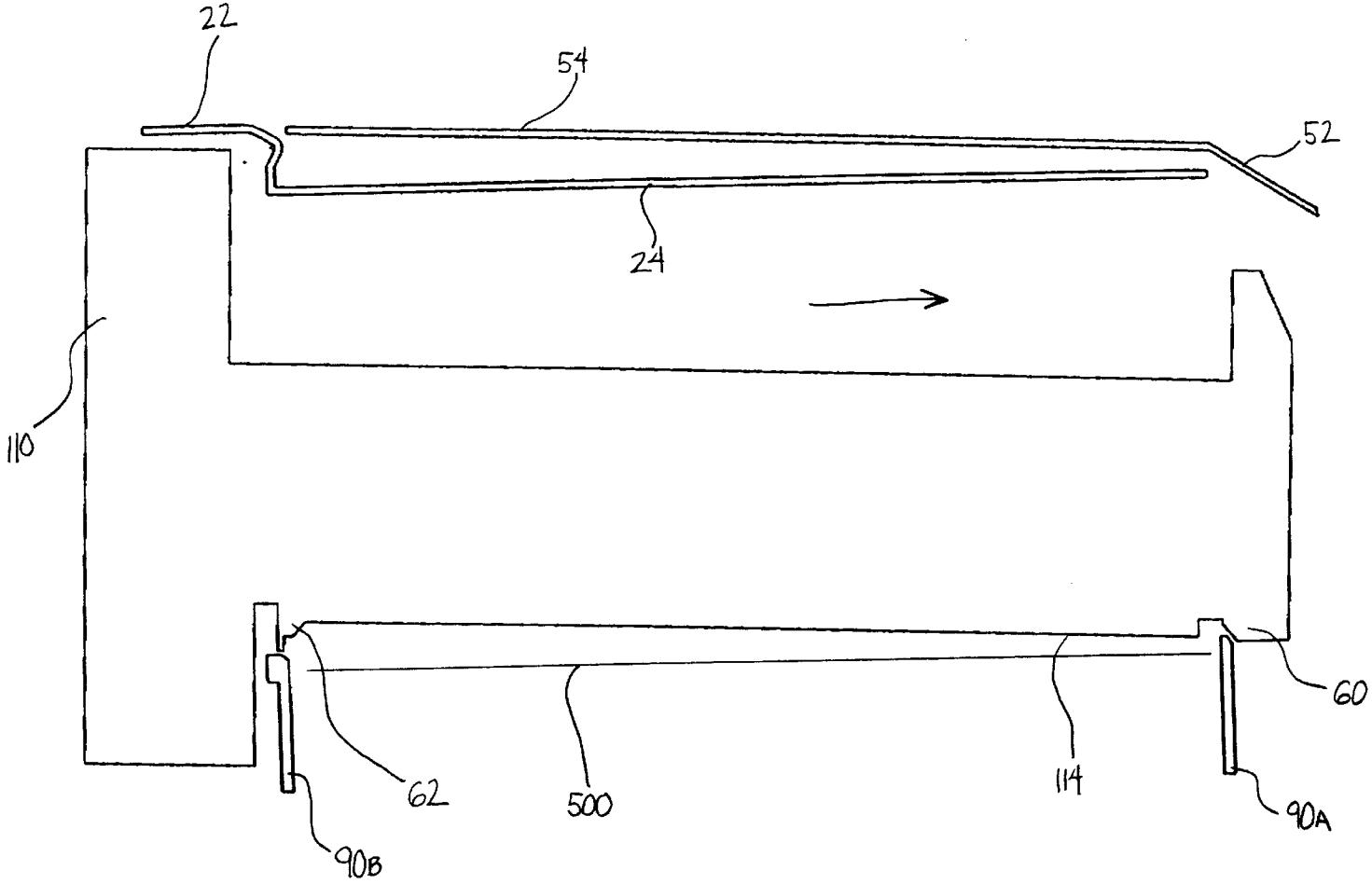
FIG. 6C is a schematic side view illustrating the cartridge being inserted into the image forming apparatus.

FIG. 6C illustrates the cartridge 110 inserted to a position that the top support 54 has slid beyond the front guide section 22. This drops the front end of the cartridge onto the front support member 90B. A front locator 62 contacts the top edge of the support member 90B. The back locator 60 continues sliding along the top edge of back support member 90A. Preferably, the back locator 60 and front locator 62 include angled surfaces to ease the movement.

Figure 6D:
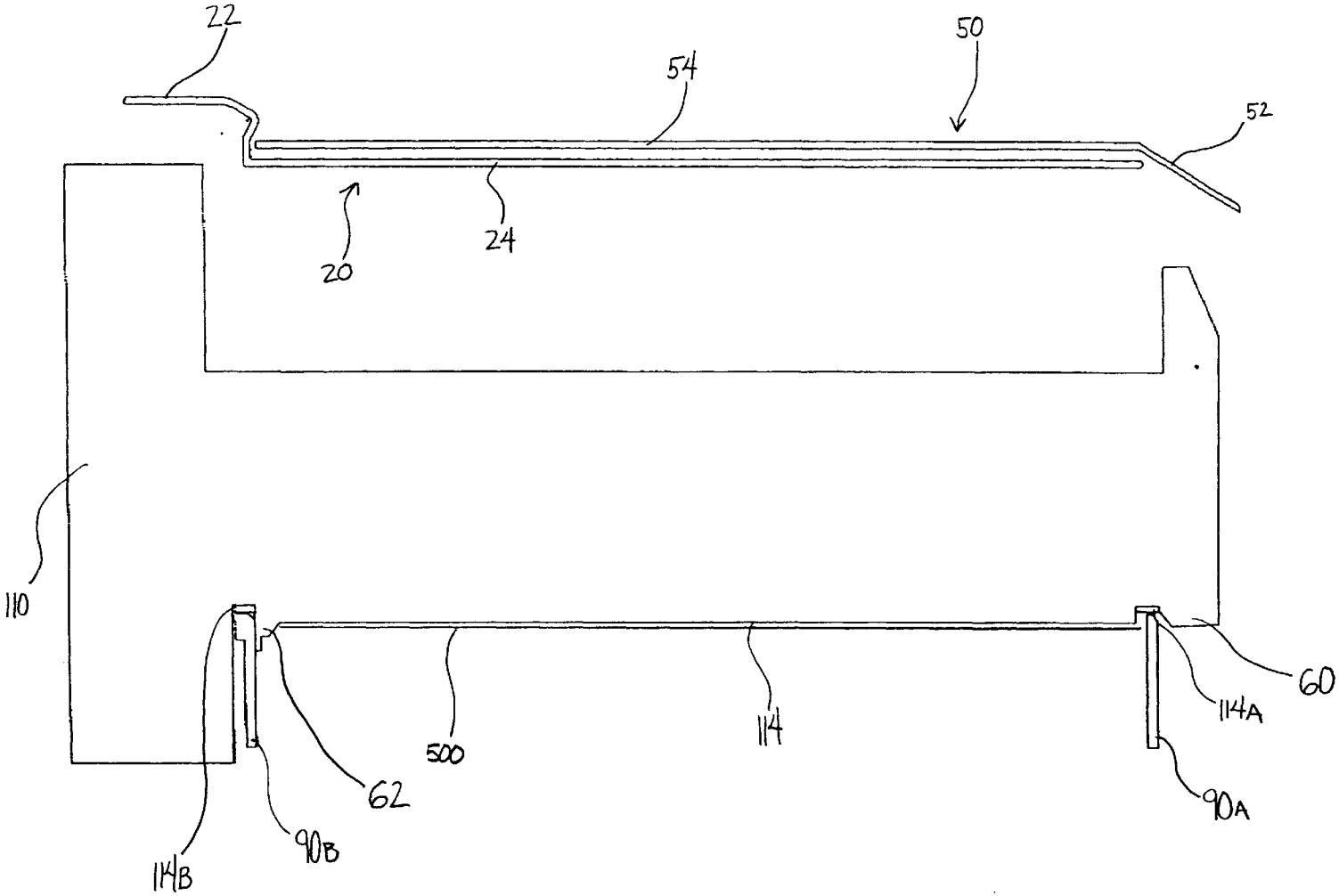
FIG. 6D is a schematic side view illustrating the cartridge being inserted into the image forming apparatus.

FIG. 6D illustrates the cartridge 110 completely inserted within the image-forming apparatus 100. The top support 54 is positioned substantially parallel with the lower guide section 24 and the ramped support 52 has cleared the lower guide section 24. The guide rails 20 and support arms 50 are decoupled as the cartridge 110 is supported by the photoconductive drum 114 positioned on the support members 90A, 90B. The back locator 60 has slid beyond the support member 90A and the front locator 62 has slid beyond support member 90B. Positioning the photoconductive drum 114 against the support members 90A, 90B is an accurate manner of placing the cartridge 110 within the image-forming apparatus. Preferably, the photoconductive drum ends 114A, 114B have a smaller diameter than the central section and the support arms 90A, 90B contact the drum at the small end positions.

As illustrated in FIG. 6D, preferably the cartridge 110 is mounted within the image forming apparatus 100 by the photoconductive drum 114 mounted on support members 90A, 90B. However, the cartridge 110 may also be supported within the image forming apparatus by other components on the cartridge. One skilled in the art will realize other components may provide support to cartridge 110 once the support arms 50 are decoupled, and it is understood to be included within the present invention.

Figure 7:
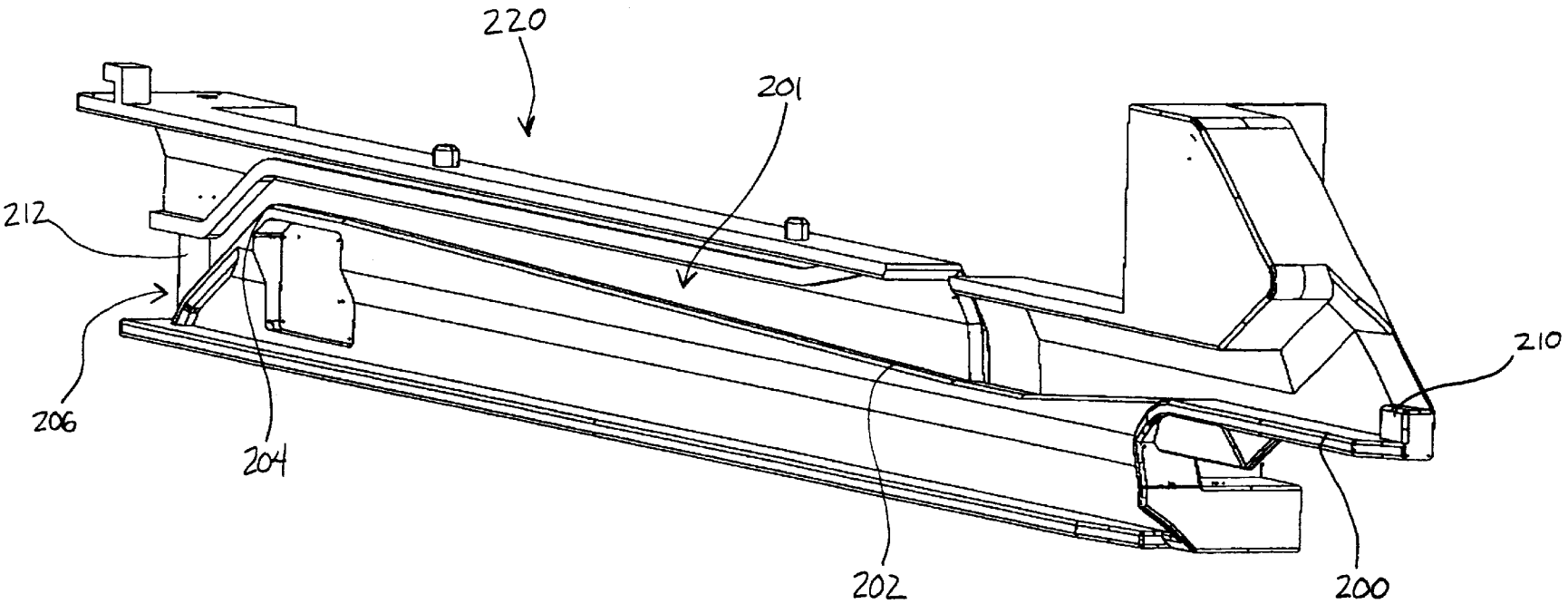
FIG. 7 is a perspective view of an alternative embodiment of a guide rail removed from the image forming apparatus.

FIG. 7 illustrates a preferred embodiment of a guide rail 220. The guide rail 220 includes a front support section 200 and a guide track 201. The guide track 201 includes a middle guide track area 202, a ramp track 204, and a track exit area 206. The guide track 201 extends a distance inward from a vertical base of the guide rail for supporting the support arms on the cartridge. Preferably, the front guide support section 200 extends inward from the vertical base a greater distance than the middle guide track to more fully support the weight of the cartridge during insertion and removal. The track exit area 206 includes an angled edge 212 that angles inward towards the vertical base. A stop 210 may be positioned on the front edge of the front guide section 200 to prevent the cartridge 110 from sliding out of the guide rails 220.

Figure 8:
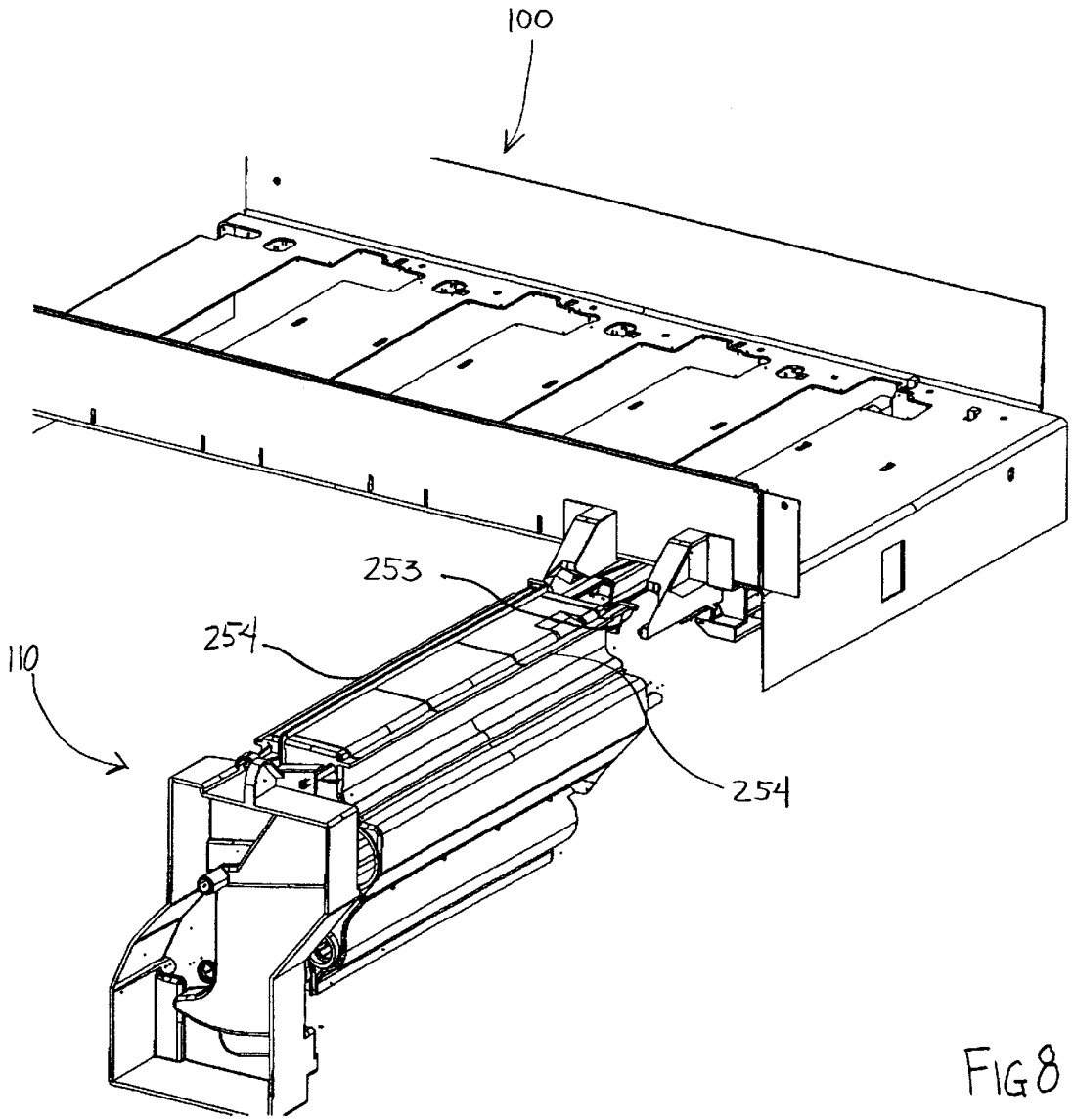
FIG. 8 is a perspective view of a cartridge having an alternative embodiment of support arms and being inserted into guide rails within the image forming apparatus.
Figure 9:
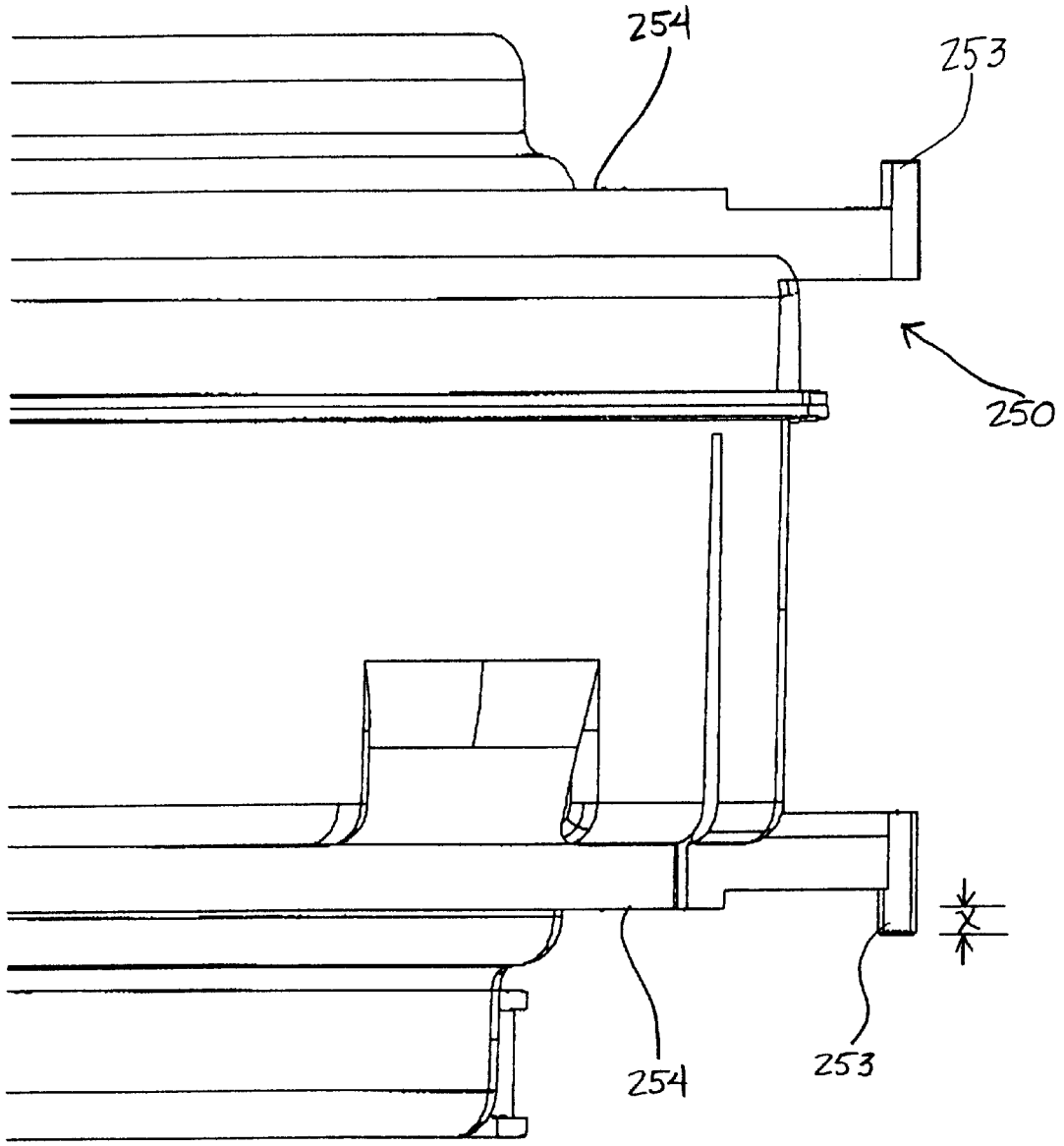
FIG. 9 is a top view of the alternative embodiment of support arms having outwardly extending prongs.

FIG. 8 illustrates a preferred embodiment of the support arms 250. The support arms 250 include top supports 254 attached to the top portion of the cartridge 110. The top supports 254 are substantially linear and do not include any ramped surfaces as in the previous design. As best illustrated in FIG. 9, the back edge of the top supports 254 includes prongs 253. The prongs 253 extend outward a distance X beyond the top supports 254.

Preferably, the top supports 254 with prongs 253 mate with guide rails 220. The top supports 254 slide along front guide section 200. The prongs 253 slide within the guide track 201 through the middle guide track area 202, ramp track 204, and track exit area 206. Preferably, the top supports 254 do not contact the guide track 201 except for the front guide section 200. As the prongs 253 slide through the ramp track 204, the back of the cartridge angles downward into the image forming apparatus. At insertion, the top supports 254 have moved beyond the front guide sections 200, and the angled edge 212 provides for the prongs 253 to decouple from the guide track 201. Therefore, the cartridge 110 is mounted within the image forming apparatus and the guide rails 220 are decoupled from the support arms 250.

In the foregoing description, like-reference characters designate like or corresponding parts throughout the several views. Also in the following description, it is to be understood that such terms as "forward," "rearward," "left," "right," "upwardly," "downwardly," and the like, are words of convenience and are not to be construed as limiting terms. Certain modifications and improvements will occur to those skilled in the art upon a reading of the foregoing description. A photoconductive drum is described and illustrated in the Figures, although the present invention may also be used with an image forming apparatus having other types of photoconductors, such as a photoconductive belt instead of a drum. It should be understood that all such modifications and improvements have been deleted for the sake of conciseness and readability but are properly within the scope of the following claims.

What is claimed is:

1. A cartridge removably mounted within an image forming apparatus comprising:

a photoconductive drum;

a developer housing positioned adjacent to said photoconductive drum for supplying toner to said photoconductive drum; and support arms extending from said developer housing for supporting the cartridge during installation and removal from the image forming apparatus, said support arms being positioned on the cartridge vertically above said photoconductive drum when mounted in the image forming apparatus, said support arms comprising a first section and a second section angled downward relative to said first section.

2. The cartridge of claim 1, wherein said developer housing is positioned above said photoconductive drum when the cartridge is mounted within the image forming apparatus.

3. The cartridge of claim 1, wherein said support arms form a substantially "T"-shape having a base centered on said developer housing and top supports extending outward from said base.

4. The cartridge of claim 3, further including ramped support surfaces at a back edge of said top supports and being angled relative to said top supports.

5. The cartridge of claim 4, wherein said ramped support surfaces are angled between about 30 and 60 degrees relative to said top supports.

6. The cartridge of claim 1, wherein said support arms are substantially linear and extend across a top area of said developer housing.

7. The cartridge of claim 6, further including a pair of prongs extending outward from a back end of said support arms.

8. An image forming apparatus comprising:

an image forming body having at least one laser imaging device positioned at an upper section, and an opening along at least one side of said body positioned below said laser imaging device, said image forming body further including guide rails mounted adjacent to said opening, and support members positioned adjacent to said opening opposite said guide rails;

at least one cartridge having a developer housing with support arms for removably mounting on said guide rails within said image forming body, said cartridge further including a photoconductive drum adjacent to said developer housing for receiving toner;

wherein said cartridge is supported within said image forming body when completely inserted by said photoconductive drum positioned against said support members.

9. The apparatus of claim 8, wherein said guide rails include a pair of opposing rails each mounted on said image forming body for mating with said support arms.

10. The cartridge of claim 9, wherein said support arms form a substantially "T"-shape having a base centered on said developer housing and top supports extending outward from said base.

11. The cartridge of claim 10, further including ramped support surfaces at a back edge of said top supports and being angled relative to said top supports.

12. The cartridge of claim 11, wherein said ramped support surfaces are angled between about 30 and 60 degrees relative to said top supports.

13. The apparatus of claim 11, wherein said guide rails include a front guide section and a lower guide section, wherein during installation and removal of the cartridge from said image forming body, said cartridge is maintained substantially level as said ramped support rides along said lower guide section and said top support rides along said front guide section.

14. The apparatus of claim 8, wherein said guide rails include a guide track extending along said guide rails.

15. The apparatus of claim 14, wherein said support arms include a pair of prongs extending outward for riding on said guide track during cartridge insertion and removal.

16. The apparatus of claim 15, wherein said guide track includes an angled edge providing for said prong to decouple from said guide rail when said cartridge is inserted within said image forming body.

17. The apparatus of claim 8, wherein said guide rails include a stop.

18. The apparatus of claim 8, wherein said opening is sized to contain four of said cartridges.

19. The apparatus of claim 8, wherein said support arms and said guide rails are spaced apart when said cartridge is inserted within said image forming body.

20. An image forming apparatus comprising:

an image forming body having an opening along at least one side;

a plurality of guide rails mounted to said image forming body above said opening;

a pair of support members positioned within said image forming body below said guide rails; and a cartridge having support arms extending outward for contacting said guide rails during insertion and removal from said image forming body, said cartridge further including a photoconductive drum positioned on a lower portion of said cartridge;

wherein upon insertion of said cartridge into said image forming body, said cartridge is supported by resting said photoconductive drum on said support members.

21. The apparatus of claim 20, further including a front locator and a back locator mounted on said cartridge adjacent said photoconductive drum for positioning said photoconductive drum on said support members.

22. The apparatus of claim 21, wherein said front and back locators include a ramped surface for sliding along said support members during insertion and removal of said cartridge from said image forming body.

23. The apparatus of claim 20, wherein said guide rails are mounted within said image forming body such that said guide rails and support arms are decoupled and the cartridge is supported by said photoconductive drum resting on said support members when said cartridge is completely inserted within said image forming body.

24. An image forming apparatus comprising:

a body having support members positioned along a lower section of said body and guide rails positioned along an upper section of said body;

a cartridge having a support arm configured to slide along said guide rails during insertion of said cartridge into said body to elevate the cartridge above said support members and lower said cartridge onto said support members when said cartridge is completely inserted into said body;

said support arms decouple from said guide rails when said cartridge is completely inserted into said body.

25. The apparatus of claim 24, wherein said support arm is angled downward on a leading edge and said guide rails are raised at a front edge such that during insertion of said cartridge into said body, said support arm leading edge slides along a back end of said guide rail to lower cartridge back end and cartridge trailing edge travels over said raised front edge to lower cartridge front end.

26. The apparatus of claim 24, wherein said support arm and said guide rails are spaced apart when said cartridge is completely inserted within said body.

27. The apparatus of claim 24, wherein said support arms are positioned alone a top section of said cartridge.

28. The apparatus of claim 24, wherein said guide rails include prongs extending outward at a leading edge of said cartridge, said prongs slide along said guide rails for inserting said cartridge into said body.

29. The apparatus of claim 28, wherein said guide rails include a ramped section along a back edge that angles downward for seating the leading cartridge edge onto said support members.

30. A method of removably mounting a cartridge within an image forming apparatus comprising the steps of:

aligning support arms positioned on the cartridge within guide rails mounted to the image forming apparatus;

pushing the cartridge into the image forming apparatus by sliding the support arms along the guide rails;

decoupling the guide rails from the support arms; and supporting the cartridge within the image forming apparatus by positioning the cartridge on a support member within the image forming apparatus.

31. The method of claim 30, wherein the cartridge is inserted into the imaging forming apparatus from one of a side and a front.

32. The method of claim 30, wherein the cartridge is supported within the image forming apparatus by positioning a photoconductive drum mounted within the cartridge on a pair of support arms positioned within the image forming apparatus.

33. A method of inserting a cartridge into an image forming apparatus comprising the steps of:

positioning support arms on an upper edge of the cartridge with guide rails within the image forming apparatus;

sliding the cartridge into the image forming apparatus by pushing the support arms along the guide rails;

lowering a first cartridge end into the image forming apparatus by sliding a ramping surface on the support arms over an inner end of the guide rails; and lowering a second cartridge end into the image forming apparatus by sliding the support arms over an upper edge of the guide rails.

34. The method of claim 33, wherein the cartridge is inserted into the image forming apparatus at an angle relative to the image forming apparatus for aligning components positioned on a back cartridge end with components within the image forming apparatus.

35. The method of claim 34, further including aligning electrical connectors on the cartridge with corresponding connectors on the image forming apparatus.

36. The method of claim 34, further including aligning gears on the cartridge with a coupler on the image forming apparatus.

37. The method of claim 33, further including lowering a front locator positioned on a bottom edge of the cartridge onto support members within the image forming apparatus.

38. The method of claim 37, further including lowering a back locator positioned on the bottom edge of the cartridge on the support members within the image forming apparatus.

* * * * *